US006143453A

United States Patent [19]

Sugimura et al.

[11] Patent Number: 6,143,453

[45] Date of Patent: Nov. 7, 2000

[54] ELECTRO-PHOTOGRAPHIC PHOTORECEPTOR AND IMAGE-FORMING APPARATUS USING SAME

[75] Inventors: Hiroshi Sugimura, Habikino; Akihiro Kondoh, Nara, both of Japan

[73] Assignee: Sharp Kabushiki Kaisha, Osaka, Japan

[21] Appl. No.: 09/379,639

[22] Filed: Aug. 24, 1999

[30] Foreign Application Priority Data

Aug. 24, 1998 [JP] Japan ..... 10-237759

[51] Int. Cl.[7] ..... G03G 5/14

[52] U.S. Cl. ..... 430/65; 399/220

[58] Field of Search ..... 430/62, 63, 64, 430/65; 399/220

[56] References Cited

U.S. PATENT DOCUMENTS

| | | | |
|---|---|---|---|
| 4,871,635 | 10/1989 | Seki et al. | 430/60 |
| 5,391,448 | 2/1995 | Katayama et al. | 430/65 |
| 5,401,600 | 3/1995 | Aizawa et al. | 430/65 |
| 5,556,728 | 9/1996 | Nogami et al. | 430/64 |
| 5,677,096 | 10/1997 | Suzuki | 430/59 |
| 5,744,271 | 4/1998 | Aizawa et al. | 430/65 |
| 5,958,638 | 9/1999 | Katayama et al. | 430/131 |
| 5,965,311 | 10/1999 | Suzuki | 430/60 |

FOREIGN PATENT DOCUMENTS

| | | |
|---|---|---|
| 37 16 975 A1 | 11/1987 | Germany . |
| 196 38 447 A1 | 4/1997 | Germany . |
| 6-202366 | 7/1994 | Japan . |
| 9-127711 | 5/1997 | Japan . |
| 11-52601 | 2/1999 | Japan . |

OTHER PUBLICATIONS

Section Ch, Week 198941, Derwent Publications Ltd., London, GB; Class 89, AN 1989–295914 XP002124411 & JP 01 217359 A (Konica) Aug. 30, 1989.

Section Ch, Week 198913, Derwent Publications Ltd., London, GB; Class 89, AN 1989–097610 XP002124412 & JP 01 046764 A (Ricoh) Feb. 21, 1989.

*Primary Examiner*—John Goodrow
*Attorney, Agent, or Firm*—Nixon & Vanderhye P.C.

[57] ABSTRACT

The object of the invention is to provide an electro-photographic photoreceptor which has high sensitivity to long wavelength light to form a less defective image and exhibits a sufficient electrical charging property at the first rotation of the receptor to rapidly form an image. The electro-photographic photoreceptor is constructed by laminating an intermediate layer, a charge generation layer and a charge transport layer in order on a conductive support. The intermediate layer contains an adhesive resin, a carboxylic acid salt of the following structural formula (I), and titanium oxide. The content of the carboxylic acid salt is in a range of 0.5–5 weight % and that of titanium oxide in 10–50 weight % for the total amount of the intermediate layer.

$$(R(COO)_k)_m A_n \quad (I)$$

wherein R is a straight, branched or cyclic, saturated or unsaturated, and mono- to tetra-valent hydrocarbon group; A is an alkali metal or alkaline earth metal; and k, m and n each represent an integer of 1–4.

8 Claims, 1 Drawing Sheet

ELECTRO-PHOTOGRAPHIC PHOTORECEPTOR AND IMAGE-FORMING APPARATUS USING SAME

BACKGROUND OF THE INVENTION

1. Field of the Invention

The present invention relates to an electro-photographic photoreceptor which, for example, can be adapted to copiers and printers, and to an image-forming apparatus using the same.

2. Description of the Related Art

An electrophotographic technology invented by C. F. Carlson affords an instantaneous and highly preservative image of high quality. This technology, accordingly, has widely been employed in the field of copiers and, recently, spread out into the field of a variety of printers and facsimile apparatus. The image-forming process in the electrophotographic technology basically comprises a step of electrically charging a photoreceptor uniformly, a step of forming an electrostatic latent image by exposure, a step of developing the electrostatic latent image with toner, a step of transfering the toner image onto a sheet of paper and a step of fixing the transferred toner image. Alternatively, the transfer of the toner image onto a sheet of paper may be achieved through an intermediate transfer.

As for the photoreceptor which works as the core of the electrophotographic technology, in addition to conventional inorganic photoconductive materials such as selenium, arsenic-selenium alloy, cadmium sulfide and zinc oxide, a photoreceptor made of organic photoconductive materials has recently been developed, which is advantageous in the view that it is nonpolluting and easily produced because film formation is easy.

A so-called laminated photoreceptor, which is made by laminating a charge generation layer and a charge transport layer, has become the mainstream in current photoreceptors and has been produced on a large scale since it is highly sensitive, the scope of selection of photoreceptive materials is so broad as to give a highly safe photoreceptor, and productivity of the coating is so high as to make the cost relatively advantageous.

Recently, on the other hand, in order to obtain an image of higher quality, and store and edit freely an input image, the digitization of image formation rapidly progresses. Heretofore, adaptation of the digital image-forming apparatus has been limited to output devices, i.e., laser printers of word processors or personal computers, LED (light emitting diode) printers and some of color laser copiers. The digitalization, however, has been extended to the field of copiers in which analogue image formation has mainly been employed until now.

It is required that the performance of the photoreceptor of the image-forming apparatus responding to such digitalization satisfies the following requirements roughly classified into three.

The first requirement is that it is sensitive to light of long wavelength. In forming a digital image, a digital electric signal has to be converted into a light signal in order to directly use information from a computer. On the other hand, when information is inputted from an original document, the information is read as light information, then once converted into digital electric signals, and converted again into light signals. In any case, the information is inputted as light signals into the photoreceptor, and the input of the digital electric signals as light signals may be achieved by means of laser or LED light. Input light which is now most frequently employed is a near infrared radiation having an oscillating wavelength of 780 nm or long wavelength light having an oscillating wavelength of 650 nm. The first requirement for the photoreceptor used in the digital image formation is that the photoreceptor has to be sensitive to such long wavelength light, and a wide variety of materials have been examined until now. In particular, phthalocyanine compounds have widely been examined and practically used since they can be synthesized in a relatively simple manner and most of them are sensitive to long wavelength light.

The second requirement is that there is no increase of residual electric potential. In forming a digital image, the image is formed by making toner adhere on a light-irradiated portion in order to effectively utilize the light or enhance resolution, that is, a reversal development process is employed in many cases. In the reversal development process, an unexposed part (electric potential of the dark part) becomes a white background and the exposed part (electric potential of the light part) becomes a black ground (line of image). In the reversal development process, accordingly, fog phenomenon, which yields black spots on the white background, never occurs even though the electric potential of the light part increases as in the normal development process, but when the electric potential of dark part decreases the fog phenomenon occurs. Therefore, a scorotron charger may often be used as a charger to keep a given electric potential of dark part at all times.

Moreover, a part at which the electrical charge potential decreases appears as a dark spot in the image. This is likely to be caused by injection of the electric charge from the conductive support, and therefore, in order to prevent the injection of the electric charge from the conductive support, such provision is made for the photoreceptor that an intermediate layer is interposed between the photoreceptive layer and the conductive support. However, since charge-blocking property of a simple resin film provided as an intermediate layer is so large as to cause an increase in residual electric potential. Therefore, a coating film is used as an intermediate layer in which conductive particles such as titanium oxide are dispersed into the resin. When the content of the resin in the intermediate layer is increased, the blocking property is enhanced to prevent occurrence of dark spots on the image, but the residual electric potential rises. On the other hand, when the content of titanium oxide is increased, the coating film tends to be uneven to yield dark spots on the image. Japanese Unexamined Patent Publication JP-A 6-202366 (1994) proposes various types of titanium oxides and combination rates of the resin to titanium oxide in the intermediate layer.

The third requirement is that there is no occurrence of moiré, i.e., striped pattern of light and shade caused by light interference in an image. In drawing a digital image on the photoreceptor, a laser light is employed. A coherent light such as laser light is apt to cause interference. In the photoreceptor, incident ray interferes with the light reflected from the conductive support to yield moiré on the image. In such a case, it has been proposed that the surface of support makes rough or an opaque intermediate layer is provided between them.

The photoreceptor satisfying the above three requirements and responding to digitalization, however, has the following disadvantage. Such a disadvantage is that, though the photoreceptor involving a phthalocyanine compound as an charge generation material is highly sensitive at the long wavelength, the charged voltage is low in the first rotation and is stabilized just after the second rotation. This phenomenon relates to the standing time after the image formation process such as electrical charging and photo-exposure. When the standing time is longer, then the charged voltage at the next first rotation is apt to be low. This phenomenon is considered to relate to the fact that the dark charge is generated by the phthalocyanine compound during standing to accumulate in the charge generation layer.

In an image-forming apparatus which is equipped with a photoreceptor using a phthalocyanine compound as a charge generation material and in which a reversal development process is employed, it is a disadvantage that the charged voltage at the first rotation is so low as to yield a fog phenomenon quite often as mentioned above and necessitates preliminary rotation as warming up once or more. Accordingly, much time is required from the start of operation of the image-forming apparatus to the actual image formation.

Heretofore, the time required for the preliminary rotation was not serious problem because a data transfer speed from a computer to a printer was lower and the image-processing time in a digital copier was longer. In recent years, however, the function of microcomputers is greatly improved and the data transfer and image-processing can be achieved quite rapidly. Therefore, it is required that the image formation could be achieved at the first rotation of the photoreceptor to speed up copying or printing of the first sheet of paper.

When the photoreceptor involving a phthalocyanine compound as a charge generation material is used in the image formation process at the first rotation, however, a change of contrast sometimes occurs due to low charged voltage at the first rotation as mentioned above and in a serious case a fog phenomenon is generated. As a result, the preliminary rotation must be made to slow down the rate of copying or printing.

In Japanese Unexamined Patent Publication JP-A 9-127711 (1997), the photoreceptive layer contains phthalocyanine and a specific azo pigment, but this is not sufficient for inhibiting decrease in the charged voltage at the first rotation.

On the other hand, Japanese Unexamined Patent Publication JP-A 11-52601 (1999) discloses a technique in which the intermediate layer contains a metal complex or metal salt of aromatic carboxylic acid and a binder resin to inhibit an effect of moisture change.

SUMMARY OF THE INVENTION

The object of the invention is to provide an electrophotographic photoreceptor which has high sensitivity to long wavelength light, which can form a less defective image, and which exhibits a sufficient electrical charging property at the first rotation of the receptor to rapidly form an image, and to provide an image-forming apparatus using the same.

The invention relates to an electro-photographic photoreceptor comprising an intermediate layer, a charge generation layer and a charge transport layer, which layers are laminated in this order on a conductive support, wherein the intermediate layer contains an adhesive resin, a carboxylic acid salt of the following formula (I), and titanium oxide, the content of the carboxylic acid salt to the total weight of the intermediate layer is selected from a range of 0.5 wt % to 5 wt %, and the content of the titanium oxide to the total weight of the intermediate layer is selected from a range of 10 wt % to 50 wt %.

$$(R(COO)_k)_mA_n \quad (I)$$

In the formula (I), R represents any of straight, branched or cyclic, saturated or unsaturated, and mono-valent to tetravalent hydrocarbon groups; A represents an alkali metal or alkaline earth metal; and k, m and n each represent an integer of 1 to 4.

According to the invention, the electrophoto-graphic photoreceptor involving the intermediate layer can form a less defective image, and exhibits a sufficient electrical charging property at the first rotation of the receptor to rapidly form an image. In other words, a less defective image can be formed by providing a titanium oxide-containing intermediate layer between a conductive layer and a photoreceptive layer composed of a charge generation layer and a charge transport layer. Moreover, sufficient electrical charging can be attained at the first rotation by adding a carboxylic acid salt and titanium oxide to the intermediate layer.

According to the invention, the electrophoto-graphic photoreceptor was constructed by placing an intermediate layer containing an adhesive resin, a given amount of carboxylic acid salt of formula (I) and a given amount of titanium oxide between a conductive support and a photoreceptive layer providing a charge generation layer and charge-transport layer. Thus, such a photoreceptor can produce a less defective image. Moreover, it can exhibit a sufficient electrical charging property even in the first rotatory movement to rapidly form an image.

In the invention it is preferable that the adhesive resin is a polyamide resin.

According to the invention, the use of a polyamide resin as an adhesive resin allows disposition of a solid intermediate layer contributing to decrease of defectiveness of the image. As for the polyamide resin, an alcohol-soluble nylon is preferred and includes, for example, a copolymeric nylon copolymerized from nylon 6, nylon 66, nylon 610, nylon 11 and nylon 12, and chemically denatured nylon such as N-alkoxymethyl denatured nylon and N-alkoxyethyl denatured nylon.

Such a polyamide resin is added to an organic solvent together with titanium oxide to form a dispersed solution, to which a carboxylic acid salt is added, and the solution is coated on a conductive layer to form an intermediate layer. The use of a polyamide resin soluble in an organic solvent allows formation of the intermediate layer in such a relatively simple manner as a dip coating method.

In this connection, the intermediate layer may preferably be formed in a range of from 0.01 $\mu$m to 20 $\mu$m in thickness, particularly from 0.05 $\mu$m to 10 $\mu$m.

According to the invention, the intermediate layer contributing to decrease of defectiveness of the image can be provided surely and easily by using a polyamide resin as an adhesive resin for the intermediate layer.

Furthermore, in the invention it is preferable that the charge generation layer contains a non-metallic phthalocyanine of X-type or $\tau$-type.

According to the invention, the electrophoto-graphic photoreceptor which involves an intermediate layer containing an adhesive resin, a carboxylic acid salt and titanium oxide, particularly containing a polyamide resin as the adhesive resin, and which involves a charge generation layer containing a non-metallic phthalocyanine of X-type or $\tau$-type, has high sensitivity to long wavelength light to form a less defective image, and moreover can exhibit a sufficient electrical charging property even in its first rotatory movement to rapidly form an image. That is, the use of the charge generation layer containing a non-metallic phthalocyanine of X-type or $\tau$-type allows high sensitivity of the photoreceptor in long wavelength light.

According to the invention, the use of the charge generation layer containing a non-metallic phthalocyanine of X-type or τ-type allows high sensitivity of the photoreceptor to long wavelength light.

Furthermore in the invention it is preferable that the charge generation layer contains titanyl phthalocyanine.

According to the invention, the electrophoto-graphic photoreceptor which involves an intermediate layer containing an adhesive resin, a carboxylic acid salt and titanium oxide, particularly containing a polyamide resin as the adhesive resin, and which involves a charge generation layer containing titanyl phthalocyanine, has high sensitivity to long wavelength light to form a less defective image, and moreover can exhibit a sufficient electrical charging property even in its first rotatory movement to rapidly form an image. That is, the use of the charge generation layer containing titanyl phthalocyanine allows high sensitivity of the photoreceptor to long wavelength light.

According to the invention, the use of the charge generation layer containing titanyl phthalocyanine allows high sensitivity to long wavelength light in the photoreceptor.

In the invention it is preferable that the titanyl phthalocyanine has a crystal form which has peaks at 7.3°±0.2°, 9.4°±0.2°, 9.7°±0.2°, and 27.3°±0.2° in the X-ray diffraction spectrum of the Bragg's angle 2θ for Cu-Kα-ray.

According to the invention, the use of the crystalline titanyl phthalocyanine assures high sensitivity to long wavelength light.

According to the invention, the titanyl phthalocyanine is preferably in a crystal form having peaks at 7.3°±0.2°, 9.4°±0.2°, 9.7°±0.2°, and 27.3°±0.2° in the X-ray diffraction spectrum of the Bragg's angle 2θ for Cu-Kα-ray. Thus, the photoreceptor surely exhibits high sensitivity to long wavelength light.

In the invention it is preferable that the titanyl phthalocyanine has a crystal form having a maximum diffraction peak at 27.3° and peaks at 7.4°±0.2°, 9.7°±0.2°, and 24.2°±0.2° in the X-ray diffraction spectrum of the Bragg's angle 2θ for Cu-Kα-ray.

According to the invention, the use of the crystalline titanyl phthalocyanine assures high sensitivity to long wavelength light.

According to the invention, the titanyl phthalocyanine is preferably in a crystal form having a maximum diffraction peak at 27.3° and peaks at 7.4°±0.2°, 9.7°±0.2°, and 24.2°±0.2° in the X-ray diffraction spectrum of the Bragg's angle 2θ for Cu-Kα-ray. Thus, the photoreceptor surely exhibits high sensitivity to long wavelength light.

The invention relates to an image-forming apparatus in which an image is formed by exposure of an electrophotographic photoreceptor and consequent reversal development, the image-forming apparatus comprising:

an electro-photographic photoreceptor including an intermediate layer which contains an adhesive resin, a carboxylic acid salt and titanium oxide, the adhesive resin being particularly a polyamide resin, and a charge generation layer which contains a non-metallic phthalocyanine of X-type or τ-type or titanyl phthalocyanine, wherein exposure of the photoreceptor is conducted with a light source having a major energy peak in 600 nm–850 nm.

According to the invention, the use of an electrophotographic photoreceptor which has a charge generation layer containing a non-metallic phthalocyanine of X-type or τ-type or titanyl phthalocyanine and which exhibits high sensitivity to long wavelength light, allows optical input of digital electric signals using long wavelength light to form a digital image. Moreover, the use of an electrophotographic photoreceptor which has an intermediate layer containing titanium oxide allows formation of a less defective image. Furthermore, the use of an electro-photographic photoreceptor which has an intermediate layer containing titanium oxide and a carboxylic acid salt allows a sufficient electrical charging property even at the first rotatory movement. Consequently, an image can be formed at the first rotation, and rapid image formation can be attained.

According to the invention, since the exposure of the electro-photographic photoreceptor is conducted with a light source having a major energy peak in 600 nm–850 nm to form an image by reversal development, optical input of digital electric signals using long wavelength light can be achieved to form a digital image. Moreover, sufficient electrical charging can be achieved even at the first rotatory movement of the eletrophotographic photoreceptor. Consequently, an image can be formed at the first rotation, and rapid image formation can be attained.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
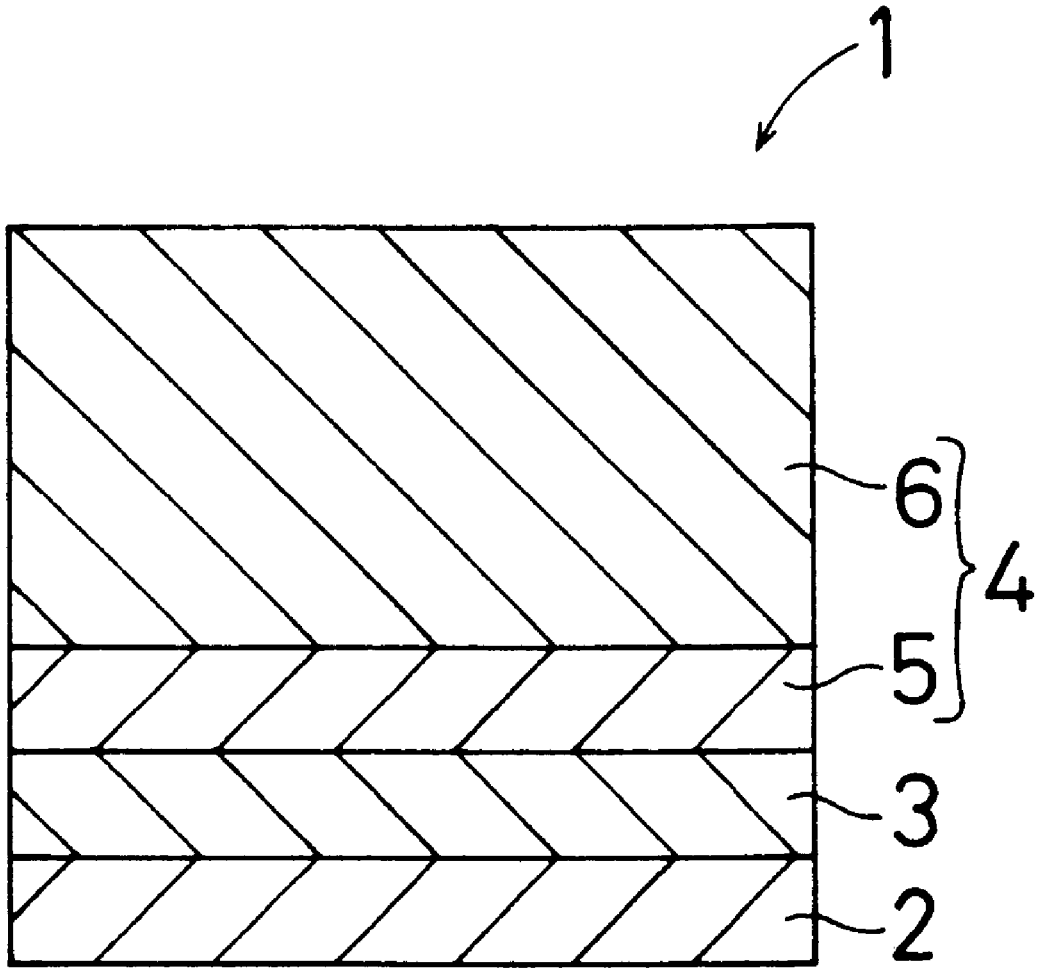
FIG. 1 shows a cross-sectional view of the electrophotographic photoreceptor 1 which is one embodiment of examples of the invention.

Now referring to the drawings, preferred embodiments of the invention are described below.

FIG. 1 shows a cross-sectional view of the electrophotographic photoreceptor 1 which is one embodiment of examples of the invention. For example, the electrophotographic photoreceptor 1 of cylinder form has the photoreceptive layer 4 on the conductive support 2. In addition, the intermediate layer 3 is placed between the conductive support 2 and the photoreceptive layer 4. The layer 4 has a laminated structure comprising the charge generation layer 5 and the charge transport layer 6. The charge generation layer 5 is disposed at the side of the intermediate layer 3.

The conductive support 2 to be employed includes, for example, a metal such as aluminum, aluminum alloy, stainless steel, iron, gold, silver, copper, zinc, nickel and titanium, a plastic substrate, polyester film or paper sheet onto which is evaporated aluminum, gold, silver, copper, nickel, indium oxide, tin oxide, or the like, a plastic or paper sheet containing conductive grains, and a plastic containing conductive polymer.

The intermediate layer 3 contains an adhesive resin, a carboxylic acid salt of the following formula (I) and titanium oxide.

$$(R(COO)_k)_m A_n \quad (I)$$

In the formula (I), R represents any of straight, branched or cyclic, saturated or unsaturated, and mono-valent to tetravalent hydrocarbon groups. A represents an alkali metal or alkaline earth metal. k, m and n each represent an integer of 1 to 4.

The content of the carboxylic acid salt to the total weight of the intermediate layer 3 is selected from a range of 0.5 wt % to 5 wt %, and the content of the titanium oxide to the total weight of the intermediate layer 3 is selected from a range of 10 wt % to 50 wt %.

The carboxylic acid salt includes those of such a monobasic carboxylic acid as acetic acid, propionic acid or benzoic acid with an alkali metal, e.g. lithium, sodium and potassium, or alkaline earth metal, e.g. calcium, magnesium, strontium and barium.

In addition, the carboxylic acid salt also includes those of a dibasic carboxylic acid having a straight, branched or cyclic alkylene group, e.g. oxalic acid, succinic acid and malonic acid, one having a phenylene group, e.g. phthalic acid, terephthalic acid and iso-phthalic acid, one having a naphthylene group, e.g. pyromellitic acid, one having a vinyl group, e.g. maleic acid and fumaric acid, and one having an acetylene group, e.g. acetylenedicarboxylic acid, with an alkali metal, e.g. lithium, sodium and potassium, or alkaline earth metal, e.g. calcium, magnesium, strontium and barium.

Moreover, the carboxylic acid salt also includes those of a tribasic carboxylic acid having a straight, branched or cyclic, saturated or unsaturated, trivalent hydrocarbon group with an alkali metal, e.g. lithium, sodium and potassium, or alkaline earth metal, e.g. calcium, magnesium, strontium and barium.

Furthermore, the carboxylic acid salt also includes those of a tetra-basic carboxylic acid having a straight, branched or cyclic, saturated or unsaturated, tetra-valent hydrocarbon group with an alkali metal, e.g. lithium, sodium and potassium, or alkaline earth metal, e.g. calcium, magnesium, strontium and barium.

Representative examples of the carboxylic acid salt of the structural formula (I) are shown below, but they are not intended to limit the scope of the invention. The carboxylic acid anion is exemplified by the following:

(1)

$CH_3COO^-$ (2)

$C_2H_5COO^-$ (3)

$C_3H_7COO^-$ (4)

$C_4H_9COO^-$ (5)

$C_6H_{11}COO^-$ (6)

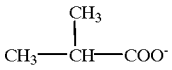

(7)

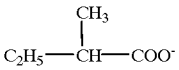

(8)

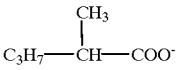

(9)

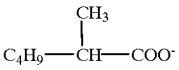

(10)

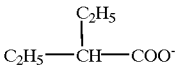

(11)

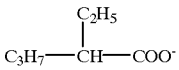

-continued (12)

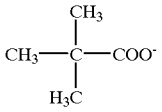

(13)

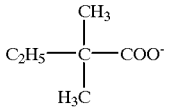

(14)

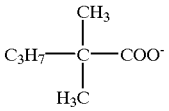

(15)

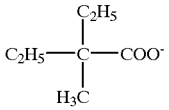

(16)

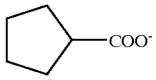

(17)

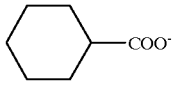

(18)

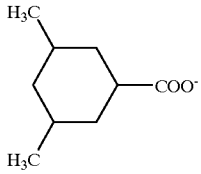

(19)

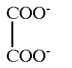

(20)

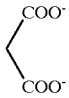

(21)

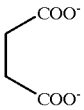

(22)

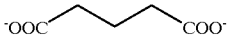

(23)

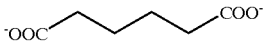

(24)

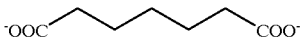

(25)

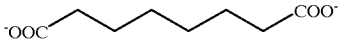

-continued (26)

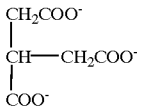

(27)

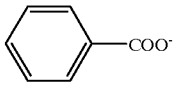

(28)

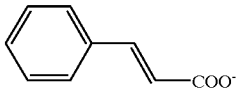

(29)

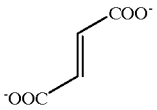

(30)

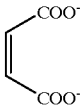

(31)

(32)

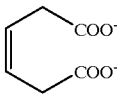

(33)

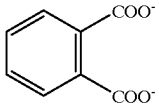

(34)

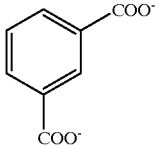

(35)

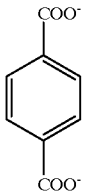

(36)

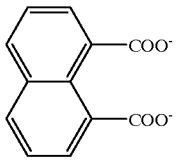

-continued (37)

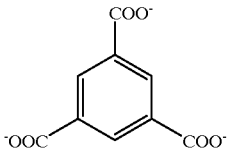

(38)

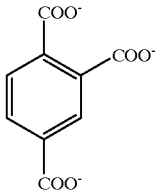

(39)

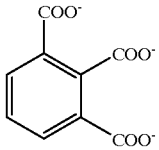

(40)

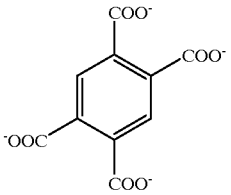

The salt with a mono-basic carboxylic acid anion includes RCOOLi, RCOONa, RCOOK, $(RCOO)_2Ca$, $(RCOO)_2Mg$, $(RCOO)_2Sr$, and $(RCOO)_2Ba$.

The salt with a di-basic carboxylic acid anion includes $R(COO)_2Li_2$, $R(COO)_2Na_2$, $R(COO)_2K_2$, $R(COO)_2Ca$, $R(COO)_2Mg$, $R(COO)_2Sr$, and $R(COO)_2Ba$.

The salt with a tri-basic carboxylic acid anion includes $R(COO)_3Li_3$, $R(COO)_3Na_3$, $R(COO)_3K_3$, $(R(COO)_3)_2Ca_3$, $(R(COO)_3)_2Mg_3$, $(R(COO)_3)_2Sr_3$, and $(R(COO)_3)_2Ba_3$.

The salt with a tetra-basic carboxylic acid anion includes $R(COO)_4Li_4$, $R(COO)_4Na_4$, $R(COO)_4K_4$, $R(COO)_4Ca_2$, $R(COO)_4Mg_2$, $R(COO)_4Sr_2$, and $R(COO)_4Ba_2$.

The crystal form of titanium oxide may be of anatase-type or rutile-type. The titanium oxide may also be surface-treated or untreated one. The shape of titanium oxide may be globular, needle or amorphous.

Preferred adhesive resin is polyamide resin. As for the polyamide resin, an alcohol-soluble nylon is particularly preferred, and includes, for example, a so-called copolymeric nylon copolymerized from nylon 6, nylon 66, nylon 610, nylon 11 and nylon 12, and chemically denatured nylon such as N-alkoxymethyl denatured nylon and N-alkoxyethyl denatured nylon.

The intermediate layer 3 may be prepared by adding titanium oxide and an adhesive resin to an organic solvent to make a dispersed solution using a ball mill, sand grinder or paint shaker, then adding a carboxylic acid salt of the structural formula (I), and coating the resulting liquid on the conductive support 2. The coating may be achieved using a Baker applicator or bar coater for sheets and by means of a spray method or a vertical ring method or a dip coating method for a cylinder. In general, the dip coating method is employed because its apparatus is simple.

The intermediate layer 3 may preferably be made in a range of from 0.01 $\mu$m to 20 $\mu$m in thickness, more preferably from 0.05 $\mu$m to 10 $\mu$m.

The photoreceptive layer 4 of the invention has a laminated structure comprising the charge generation layer 5 and the charge transport layer 6.

The charge generation material contained in the charge generation layer 5 is preferably a phthalocyanine compound. For example, non-metallic phthalocyanines or phthalocyanines coordinated with metals such as copper, indium, gallium, tin, titanium, zinc and vanadium, their oxides or their chlorides are employed. Particularly, highly sensitive non-metallic phthalocyanines of X-type or τ-type and titanyl phthalocyanine are preferred.

Moreover, the titanyl phthalocyanine is particularly preferable in a crystal form having peaks at 7.3°±0.2°, 9.4°±0.2°, 9.7°±0.2°, and 27.3°±0.2°, or in a crystal form having a maximum diffraction peak at 27.3° and peaks at 7.4°±0.2°, 9.7°±0.2°, and 24.2°±0.2° in the X-ray diffraction spectrum of the Bragg's angle 2θ for Cu-Kα-ray.

The charge generation layer 5 may be prepared by adding an organic solvent to fine particles of the phthalocyanine to make a dispersed solution in a similar apparatus to that used in preparation of the intermediate layer 3 and coating it. In order to enhance adhesiveness, an adhesive resin, for example, polyester resin, polyvinyl acetate, polyacrylate, polycarbonate, polyallylate, polyvinyl acetacetal, polyvinyl propional, polyvinyl butyral, phenoxy resin, epoxy resin, urethane resin, melamine resin, silicone resin, acryl resin, cellulose ester, cellulose ether, and vinyl chloride-vinyl acetate copolymer resin, may be added.

The charge generation layer 5 may be made in a range of 0.05 μm to 5 μm in thickness, preferably in a range of 0.1 μm to 1 μm.

If required, a variety of additives such as leveling agent, anti-oxidant and sensitizer may be added to the charge generation layer 5 to improve a coating effect.

The charge transport layer 6 comprises mainly a charge transport material and an adhesive resin. The charge transport material includes electron-attracting materials, e.g. 2,4,7-trinitrofluorenone and tetra-cyanoquinodimethane, heterocyclic compounds, e.g. carbazole, indole, imidazole, oxazole, pyrazole, oxadiazole, pyrazoline and thiadiazole, aniline derivatives, hydrazone compounds, aromatic amine derivatives, styryl compounds, enamine compounds, and electron-donating materials such as polymers having the above compounds as a major group or side chain group. These charge transport materials may be used alone or in combination thereof. The charge transport material adheres to the adhesive resin to form an charge transport layer 6.

The adhesive resin used in the charge transport layer 6 includes vinyl polymers, e.g. polymethyl methacrylate, polystyrene and polyvinyl chloride, and their copolymers, and polycarbonate, polyester, polyester carbonate, polyallylate, polysulfone, polyimide, phenoxy, epoxy and silicone resins, and their partially bridged hardened materials. These adhesive resins may be used alone or in combination thereof.

The ratio of the charge transport material to be used for the adhesive resin is usually in a range of 30 weight parts to 200 weight parts, preferably 40 weight parts to 150 weight parts, for 100 weight parts of the adhesive resin.

The charge transport layer 6 may be made in a range of 5 μm to 50 μm in thickness, preferably in a range of 10 μm to 45 μm.

In addition, a known additive such as plasticizer, anti-oxidant, UV absorbent and leveling agent may be added to the charge transport layer 6 to improve film formation, flexibility and coating effect.

The charge transport layer 6 may be made on the charge generation layer 5 by applying in a similar apparatus as used in preparation of the intermediate layer 3.

If required, in order to protect the surface of the photoreceptive layer 4, a protective layer may be provided. As for the surface-protective layer, a thermoplastic resin or photo- or thermo-hardening resin may be used.

Thus resulting electro-photographic photoreceptor 1 exhibits high sensitivity to long wavelength light, e.g. near infrared radiation, and affords a faultless image. Since it can be charged sufficiently even at the first rotation and used in the image formation process at the first rotation, a rapidly image-forming apparatus can be provided.

The image formation process to which the electro-photographic photoreceptor 1 of the invention can be adapted comprises at least an electrical charging process, exposure process, reversal development process and transfer process, each of which can be carried out in the known art.

In the electrical charging process, for example, a technique such as corotron or scorotron electrical charging in which a corona discharge is utilized, as well as contact electrical charging using a conductive roller or brush can be applied. In the electrical charging technique utilizing a corona discharge, in many cases, the scorotron electrical charging may be employed to maintain a given electric potential in a dark place.

In the exposure process, a light source such as semiconductor laser which exhibits a major energy peak at 600 nm–850 nm is preferably used to make exposure.

In the development process, a usual method for development in which a magnetic or non-magnetic, uni-component or binary developer is contacted or not contacted may be employed. In any case, a reversal development process is used to develop the electric potential at a light part.

In the transfer process, such a technique as transfer by corona discharge or transfer using a transfer roller may be employed.

In general, a fixing process is employed to fix the developer on a sheet of paper and the like. In this process, a fixing procedure with heat or pressure is usually employed. In addition to these processes, it is also appropriate to add a cleaning process for eliminating unnecessary developer adhering on the photoreceptor surface and a charge-removing process for removing the charge from the photoreceptor surface.

The electro-photographic photoreceptor 1 of the invention can be used in a process for forming an image at the first rotation of the photoreceptor, as well as in a so far utilized image-forming process in which the image is formed after the second rotation. In the so far used photoreceptor containing phthalocyanine as a charge generation material, the electrification voltage at the first rotation is so low that the development occurs in the reversal development step though no image formation is conducted. This sometimes has an adverse effect on the image formation conducted after the second rotation. The electro-photographic photoreceptor 1 of the invention is sufficiently charged at the first rotation, so such an adverse effect can be suppressed.

EXAMPLES

The present invention is explained in more detail by the following examples, but not limited by them as far as they are not out of the purpose of the invention.

Example 1

To a mixture of 287 weight parts of methanol and 533 weight parts of 1,2-dichloroethane were added 71.6 weight parts of titanium oxide (STR-60N; made by Sakai Chemical Co., Ltd.) and 107.4 weight parts of copolymer nylon (Amilan CM8000; made by Toray Industries Inc.), and the mixture was dispersed with a paint shaker for 8 hours. After addition of 1 weight part of sodium acetate as the carboxylic acid salt, the mixture was stirred to give a coating solution for forming the intermediate layer. The solution was filled into a tank, into which a cylindric aluminum conductive support 2 of 65 mm in diameter and 332 mm in length was dipped. The support was pulled out from the solution to form a coating film, and dried at 110° C. for 10 minutes to make the intermediate layer 3 of about 1 μm in thickness.

Then a mixture of 2 weight parts of titanyl phthalocyanine as a charge generation material which was in a crystal form having peaks at 7.3°±0.2°, 9.4°±0.2°, 9.7°±0.2°, and 27.3°±0.2° in the X-ray diffraction spectrum of the Bragg's angle 2θ for Cu-Kα-ray, 1 weight part of polyvinyl butyral (Essreck BM1; made by Sekisui Chemical Co., Ltd.) and 97 weight parts of methyl ethyl ketone was dispersed in a paint shaker for 1 hour to give a dispersed solution for forming a charge generation layer. This was filled into a tank, into which the cylindric aluminum conductive support 2 providing the above intermediate layer 3 was dipped. The support was then pulled out from the solution to form a coating film, and dried at room temperature for 1 hour to make the charge generation layer 5 of about 0.2 μm in thickness.

On the other hand, 1 weight part of a hydrazone compound of formula:

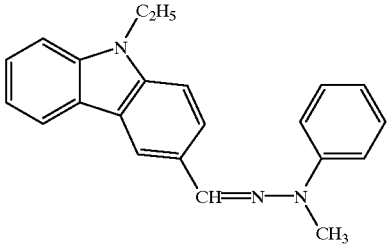

as a charge transport material and 1 weight part of polycarbonate (C-1400; made by Teijin Chemical Ltd.) as an adhesive resin were dissolved in 8 weight parts of dichloromethane to give a solution for coating a charge transport layer. This was applied on the charge generation layer 5 made on the above conductive support 2 by dipping, and the support was dried at 80° C. for 1 hour to form the charge transport layer 6. Thus, an electro-photographic photoreceptor 1 as shown in FIG. 1 was provided.

Since the electrical charging potential of the electro-photographic photoreceptor decreases in a commercially available copier (AR5130: Sharp Co., Ltd.) when allowed to stand for a long period of time, a round full rotation process for charge removal must be conducted before starting the image formation process. Thus, in order to confirm the effect of the electro-photographic photoreceptor 1 of the invention, the program for the image formation process was rewritten to omit the preliminary rotation movement before the image formation. In this modified copier was installed an equipment for measuring the electric potential on the photoreceptor surface, and the electro-photographic photoreceptor 1 prepared as mentioned above was installed therein. After lapse of 1 hour, the surface electrical potentials at the first and second rotations of the photoreceptor 1 were measured. Then, after lapse of 1 hour, the image was confirmed, the copying was repeated, and the electrical charge potential (Vo), half tone electric potential (Vh) and residual electric potential (Vr) after repeated use of 10,000 times were measured. The result is shown in Table 1. It was found from Table 1 that all of the surface electric potential, the image characteristic and the characteristics of repetition were very well.

TABLE 1

| | 1st rotat. Vo1 | 2nd rotat. Vo2 | Vh2 | Vr2 | Image charac. | Electric potential after 10,000 repetits. Vo 10000 | Vh 10000 | Vr 10000 |
|---|---|---|---|---|---|---|---|---|
| Ex. 1 | −503 | −507 | −260 | −35 | Good | −500 | −262 | −37 |
| Ex. 2 | −510 | −513 | −255 | −33 | Good | −502 | −258 | −35 |
| Ex. 3 | −507 | −509 | −250 | −30 | Good | −500 | −253 | −33 |
| Ex. 4 | −509 | −511 | −254 | −34 | Good | −502 | −258 | −36 |
| Ex. 5 | −505 | −507 | −255 | −36 | Good | −501 | −256 | −37 |
| Ex. 6 | −502 | −505 | −257 | −35 | Good | −501 | −258 | −37 |
| Ex. 7 | −500 | −501 | −260 | −30 | Good | −502 | −262 | −32 |
| Ex. 8 | −511 | −513 | −252 | −33 | Good | −505 | −255 | −35 |
| Ex. 9 | −513 | −514 | −258 | −32 | Good | −507 | −259 | −33 |
| Ex. 10 | −502 | −505 | −253 | −34 | Good | −500 | −255 | −36 |
| Ex. 11 | −505 | −504 | −249 | −33 | Good | −500 | −253 | −35 |
| Ex. 12 | −500 | −500 | −255 | −35 | Good | −502 | −256 | −38 |
| Ex. 13 | −503 | −502 | −254 | −37 | Good | −501 | −259 | −39 |
| Ex. 14 | −505 | −506 | −257 | −33 | Good | −501 | −259 | −36 |
| Ex. 15 | −507 | −510 | −253 | −38 | Good | −507 | −257 | −39 |
| Ex. 16 | −500 | −503 | −251 | −29 | Good | −500 | −253 | −33 |
| Ex. 17 | −501 | −505 | −265 | −32 | Good | −501 | −269 | −34 |
| Ex. 18 | −503 | −505 | −300 | −45 | Good | −500 | −303 | −48 |
| Ex. 19 | −502 | −505 | −305 | −40 | Good | −503 | −309 | −43 |
| Comp. Ex. 1 | −410 | −497 | −256 | −30 | Partial fog | −501 | −258 | −33 |
| Comp. Ex. 2 | −505 | −507 | −250 | −23 | Totally dark spots | −505 | −252 | −25 |
| Comp. Ex. 3 | −450 | −530 | −301 | −110 | Thin image | −570 | −350 | −220 |
| Comp. Ex. 4 | −501 | −500 | −260 | −25 | Totally dark spots | −503 | −263 | −27 |

Example 2

The electro-photographic photoreceptor 1 was prepared in the same manner as in Example 1, provided that 70 weight parts of titanium oxide (STR-60N; made by Sakai Chemical Ind. Co., Ltd.), 105 weight parts of copolymer nylon (Amilan CM8000; made by Toray Industries Inc.) and 5 weight parts of sodium acetate were used. The characteristics of electric potential were evaluated. The result indicated that it was better as shown in Table 1.

Example 3 The electro-photographic photoreceptor 1 was prepared in the same manner as in Example 1, provided that 68.4 weight parts of titanium oxide (STR-60N; made by Sakai Chemical Ind. Co., Ltd.), 102.6 weight parts of copolymer nylon (Amilan CM8000; made by Toray Industries Inc.) and 9 weight parts of sodium acetate were used. The characteristics of electric potential were evaluated. The result indicated that it was better as shown in Table 1.

Example 4

The electro-photographic photoreceptor 1 was prepared in the same manner as in Example 2, provided that 5 weight parts of potassium acetate were used in place of sodium acetate as a carboxylic acid salt. The characteristics of electric potential were evaluated. The result indicated that it was better as shown in Table 1.

Example 5

The electro-photographic photoreceptor 1 was prepared in the same manner as in Example 2, provided that 5 weight parts of sodium benzoate were used in place of sodium acetate as a carboxylic acid salt. The characteristics of electric potential were evaluated. The result indicated that it was better as shown in Table 1.

Example 6

The electro-photographic photoreceptor 1 was prepared in the same manner as in Example 2, provided that 5 weight parts of sodium succinate were used in place of sodium acetate as a carboxylic acid salt. The characteristics of electric potential were evaluated. The result indicated that it was better as shown in Table 1.

Example 7

The electro-photographic photoreceptor 1 was prepared in the same manner as in Example 2, provided that 5 weight parts of sodium maleate were used in place of sodium acetate as a carboxylic acid salt. The characteristics of electric potential were evaluated. The result indicated that it was better as shown in Table 1.

Example 8

The electro-photographic photoreceptor 1 was prepared in the same manner as in Example 2, provided that 5 weight parts of magnesium acetate were used in place of sodium acetate as a carboxylic acid salt. The characteristics of electric potential were evaluated. The result indicated that it was better as shown in Table 1.

Example 9

The electro-photographic photoreceptor 1 was prepared in the same manner as in Example 2, provided that 5 weight parts of calcium acetate were used in place of sodium acetate as a carboxylic acid salt. The characteristics of electric potential were evaluated. The result indicated that it was better as shown in Table 1.

Example 10

The electro-photographic photoreceptor 1 was prepared in the same manner as in Example 2, provided that 70 weight parts of surface-untreated granular titanium oxide (TTO-55N; made by Ishihara Sangyo Kaisha Ltd.) were used in place of the surface-untreated needle-like titanium oxide (STR-60N; made by Sakai Chemical Ind. Co., Ltd.). The characteristics of electric potential were evaluated. The result indicated that it was better as shown in Table 1.

Example 11

The electro-photographic photoreceptor 1 was prepared in the same manner as in Example 2, provided that 70 weight parts of needle-like titanium oxide (STR-60; made by Sakai Chemical Ind. Co., Ltd.) of which the surface was treated with $Al_2O_3$ were used in place of the surface-untreated needle-like titanium oxide (STR-60N; made by Sakai Chemical Ind. Co., Ltd.). The characteristics of electric potential were evaluated. The result indicated that it was better as shown in Table 1.

Example 12

The electro-photographic photoreceptor 1 was prepared in the same manner as in Example 2, provided that 70 weight parts of needle-like titanium oxide (STR-60S; made by Sakai Chemical Ind. Co., Ltd.) of which the surface was treated with $SiO_2$ were used in place of the surface-untreated needle-like titaniumoxide (STR-60N; made by Sakai Chemical Ind. Co., Ltd.). The characteristics of electric potential were evaluated. The result indicated that it was better as shown in Table 1.

Example 13

The electro-photographic photoreceptor 1 was prepared in the same manner as in Example 2, provided that 105 weight parts of N-methoxymethyl nylon (EF-30T; made by Teikoku Chemical Ind. Co., Ltd.) were used in place of copolymer nylon (Amilan CM8000; made by Toray Industries Inc.). The characteristics of electric potential were evaluated. The result indicated that it was better as shown in Table 1.

Example 14

The electro-photographic photoreceptor 1 was prepared in the same manner as in Example 2, provided that a mixture of 583 weight parts of methanol and 237 weight parts of toluene were used as a solvent for a coating solution for forming an intermediate layer. The characteristics of electric potential were evaluated. The result indicated that it was better as shown in Table 1.

Example 15

The electro-photographic photoreceptor 1 was prepared in the same manner as in Example 1, provided that 18 weight parts of titanium oxide (STR-60N; made by Sakai Chemical Ind. Co., Ltd.), 157 weight parts of copolymer nylon (Amilan CM8000; made by Toray Industries Inc.) and 5 weight parts of sodium acetate were used. The characteristics of electric potential were evaluated. The result indicated that it was better as shown in Table 1.

Example 16

The electro-photographic photoreceptor 1 was prepared in the same manner as in Example 1, provided that 90 weight parts of titanium oxide (STR-60N; made by Sakai Chemical Ind. Co., Ltd.), 85 weight parts of copolymer nylon (Amilan CM8000; made by Toray Industries Inc.) and 5 weight parts of sodium acetate were used. The characteristics of electric potential were evaluated. The result indicated that it was better as shown in Table 1.

Example 17

The electro-photographic photoreceptor 1 was prepared in the same manner as in Example 2, provided that titanyl phthalocyanine of a crystal form having a maximum diffraction peak at 27.3° and peaks at 7.4°±0.2°, 9.7°±0.2°, and 24.2°±0.2° in the X-ray diffraction spectrum of the Bragg's angle 2θ for Cu-Kα-ray was used as a charge generation material. The characteristics of electric potential were evaluated. The result indicated that it was better as shown in Table 1.

Example 18

The electro-photographic photoreceptor 1 was prepared in the same manner as in Example 2, provided that a non-metallic phthalocyanine of X-type (Fastgen Blue-8120; made by Dainippon Ink & Chemicals, Inc.) was used as a charge generation material. The characteristics of electric potential were evaluated. The result indicated that it was better as shown in Table 1.

Example 19

The electro-photographic photoreceptor 1 was prepared in the same manner as in Example 2, provided that a non-metallic phthalocyanine of τ-type was used as a charge generation material. The characteristics of electric potential were evaluated. The result indicated that it was better as shown in Table 1.

Comparative Example 1

(In a case of using no carboxylic acid salt)

The electro-photographic photoreceptor 1 was prepared in the same manner as in Example 1, provided that 72 weight parts of titanium oxide (STR-60N; made by Sakai Chemical Ind. Co., Ltd.) and 109 weight parts of copolymer nylon (Amilan CM8000; made by Toray Industries Inc.) were used but no sodium acetate was added. The characteristics of electric potential were evaluated. As shown in Table 1, the result indicated that the reversal development yielded fog because the electrical charging potential was low at the first rotation.

Comparative Example 2

(In a case of using an excess amount of carboxylic acid salt)

The electro-photographic photoreceptor 1 was prepared in the same manner as in Example 1, provided that 57.6 weight parts of titanium oxide (STR-60N; made by Sakai Chemical Ind. Co., Ltd.), 86.4 weight parts of copolymer nylon (Amilan CM8000; made by Toray Industries Inc.) and 36 weight parts of sodium acetate were used. The characteristics of electric potential were evaluated. As shown in Table 1, the result showed occurrence of dark spots all over the copied image.

Comparative Example 3

(In case of using no titanium oxide)

The electro-photographic photoreceptor 1 was prepared in the same manner as in Example 1, provided that titanium oxide (STR-60N; made by Sakai Chemical Ind. Co., Ltd.) was not used, and 175 weight parts of copolymer nylon (Amilan CM8000; made by Toray Industries Inc.) and 5 weight parts of sodium acetate were used. The characteristics of electric potential were evaluated. As shown in Table 1, the result showed a high residual electric potential and a weak image contrast in the reversal development.

Comparative Example 4

(In a case of using an excess amount of titanium oxide)

The electro-photographic photoreceptor 1 was prepared in the same manner as in Example 1, provided that 108 weight parts of titanium oxide (STR-60N; made by Sakai Chemical Ind. Co., Ltd.), 67 weight parts of copolymer nylon (Amilan CM8000; made by Toray Industries Inc.) and 5 weight parts of sodium acetate were used. The characteristics of electric potential were evaluated. As shown in Table 1, the result showed occurrence of dark spots all over the copied image.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An electro-photographic photoreceptor comprising:

an intermediate layer;

a charge generation layer; and a charge transport layer, the layers being laminated in this order on a conductive support, wherein the intermediate layer contains an adhesive resin, a carboxylic acid salt of the following formula (I), and titanium oxide, $$(R(COO)_k)_m A_n \quad (I)$$

wherein R represents any of straight, branched or cyclic, saturated or unsaturated, and mono-valent to tetra-valent hydrocarbon groups; A represents an alkali metal or alkaline earth metal; and k, m and n each represent an integer of 1 to 4, content of the carboxylic acid salt to the total weight of the intermediate layer is selected from a range of 0.5 wt % to 5 wt %, and content of the titanium oxide to the total weight of the intermediate layer is selected from a range of 10 wt % to 50 wt %.

2. The electro-photographic photoreceptor of claim 1, wherein the adhesive resin is a polyamide resin.

3. The electro-photographic photoreceptor of claim 1, wherein the charge generation layer contains a non-metallic phthalocyanine of X-type or τ-type.

4. The electro-photographic photoreceptor of claim 1, wherein the charge generation layer contains titanyl phthalocyanine.

5. The electro-photographic photoreceptor of claim 4, wherein the titanyl phthalocyanine has a crystal form which has peaks at 7.3°±0.2°, 9.4°±0.2°, 9.7°±0.2°, and 27.3°±0.2° in the X-ray diffraction spectrum of the Bragg's angle 2θ for Cu-Kα-ray.

6. The electro-photographic photoreceptor of claim 4, wherein the titanyl phthalocyanine has a crystal form having a maximum diffraction peak at 27.3° and peaks at 7.4°±0.2°, 9.7°±0.2°, and 24.2°±0.2° in the X-ray diffraction spectrum of the Bragg's angle 2θ for Cu-Kα-ray.

7. An image-forming apparatus in which an image is formed by exposure of an electro-photographic photoreceptor and consequent reversal development, the image-forming apparatus comprising:

the electro-photographic photoreceptor of claim 3, wherein exposure of the photoreceptor is conducted with a light source having a major energy peak in 600 nm–850 nm.

8. An image-forming apparatus in which an image is formed by exposure of an electro-photographic photoreceptor and consequent reversal development, the image-forming apparatus comprising:

the electro-photographic photoreceptor of claim 4, wherein exposure of the photoreceptor is conducted with a light source having a major energy peak in 600 nm–850 nm.

* * * * *